United States Patent [19]

Kokelenberg et al.

[11] Patent Number: 4,810,623

[45] Date of Patent: Mar. 7, 1989

[54] DEVELOPMENT OF PHOTOGRAPHIC SILVER HALIDE EMULSION MATERIALS

[75] Inventors: Hendrik E. Kokelenberg, Schoten; Benedictus J. Jansen, Geel, both of Belgium

[73] Assignee: Agfa-Gevaert N.V., Mortsel, Belgium

[21] Appl. No.: 156,750

[22] Filed: Feb. 18, 1988

[30] Foreign Application Priority Data

Feb. 24, 1987 [EP] European Pat. Off. ..... 87200289.4

[51] Int. Cl.[4] ..... G03C 1/02; G03C 1/06; G03C 5/24; G03C 5/30

[52] U.S. Cl. ..... 430/448; 430/434; 430/435; 430/436; 430/438; 430/440; 430/484; 430/490; 430/492; 430/966; 430/967

[58] Field of Search ..... 430/434, 435, 436, 438, 430/440, 448, 489, 490, 492, 966, 967

[56] References Cited

U.S. PATENT DOCUMENTS

| | | | |
|---|---|---|---|
| 3,260,598 | 7/1966 | Yutzy et al. | 430/206 |
| 4,130,428 | 12/1978 | Van Doorselaer | 430/139 |
| 4,177,071 | 12/1979 | De Brabandere et al. | 430/494 |
| 4,224,402 | 9/1980 | Vermeulen et al. | 430/204 |
| 4,362,795 | 12/1982 | Ogawa et al. | 430/966 |
| 4,609,621 | 9/1986 | Sugimoto et al. | 430/567 |
| 4,624,913 | 11/1986 | Miyasaka et al. | 430/966 |
| 4,632,896 | 12/1986 | Tsubai et al. | 430/244 |
| 4,672,025 | 6/1987 | Yamada et al. | 430/420 |
| 4,680,252 | 7/1987 | Suzuki et al. | 430/364 |

FOREIGN PATENT DOCUMENTS 0907203 9/1962 United Kingdom .

*Primary Examiner*—Mukund J. Shah
*Attorney, Agent, or Firm*—William J. Daniel

[57] ABSTRACT

A process for developing a photographic material containing on a support an image-wise exposed silver halide emulsion layer of which the silver halide is substantially silver chloride and in which the photographic material before its exposure contains already at least one silver halide developing agent in a hydrophilic colloid binder in waterpermeable relationship with the silver halide, said process containing the step of contacting the exposed photographic material with an aqueous alkaline liquid, called activator liquid, being initially substantially free from developing agent(s), said contacting being not followed by a silver complex diffusion transfer processing, characterized in that said aqueous alkaline liquid contains a primary and/or secondary amine.

11 Claims, No Drawings

DEVELOPMENT OF PHOTOGRAPHIC SILVER HALIDE EMULSION MATERIALS

The present invention relates to the development of photographic silver halide emulsion materials.

In normal processing of exposed photographic silver halide emulsion materials the various processing steps are carried out at ambient temperature (20°-25° C.) and require a relatively long time, say several minutes. Therefore, thereis a general trend to enhance the speed of processing especially in the field of radiography wherein often a very rapid access to the radiograph is vital in diagnosis. Processing times less than 90 seconds are possible by increasing the processing temperature but require specially hardened emulsion layers in order to have sufficient resistance to abrasion in machine processing wherein the photographic material is led between conveyor rollers. Moreover, higher temperatures accelerate aerial oxidation of the developing agents so that developing baths, unless special protection measures against the oxygen of the air are taken, become rapidly exhausted and are causing staining. Further, higher temperatures than the ambient require a certain input of energy which makes high temperature processing less economical.

In most of the commercial X-ray materials the silver halide emulsions are of the silver bromide type containing minor amounts of silver iodide [ref. "Radiographic Processing" by D. H. O. John—Focal Press—London-New York (1967), p. 82]. The use of more rapidly developing silver chloride instead of silver bromide in radiographic materials has been described in GP-P No. 907,023.

In addition to the temperature the alkalinity of the developer plays a major role in rapid access processing and is normally situated in a pH range of 10 to 12. The higher the alkalinity the faster the development proceeds but also the more rapidly the developer is oxidized by the air.

In order to avoid the disadvantages of normal development with the developing agent(s) in the alkaline developing solution so-called activation processing has been introduced. Activation processing is applied e.g. in combination with rapid access stabilization as described in U.S. Pat. No. 4,030,924. In activation processing use is made of photographic silver halide emulsion materials containing already before image-wise exposure one or more developing agents in their composition, e.g. in a hydrophilic colloid layer adjacent to the silver halide emulsion layer. The processing bath used in the activation development of the latent silver image is an aqueous alkaline solution being free from any developing agent.

It has now been found experimentally by use that silver bromide type emulsions show a markedly high drop in image density when subjected to activation processing compared with normal development.

It has further been found experimentally by us that the behaviour of silver chloride emulsions in activation processing is practically the same as in normal processing but for a same exposure dose they do not yield an image density as high as obtained with a silver bromide type emulsion of same grain size and coverage of silver halide.

Still further it has been found experimentally by us that the use of primary and/or secondary amines in an aqueous liquid used for activation processing of an exposed silver halide emulsion layer substantially containing silver bromide has no or only neglectable influence on maximum density. However, the maximum density and speed of a silver chloride emulsion is increased when the photographic material already contains developing agents such as hydroquinone and a 3-pyrazolidinone and when the development proceeds with an aqueous alkaline activation solution containing a primary and/or secondary amino compound; a much lower increase is obtained by activation solutions containing a tertiary amine.

According to GB-P No. 1,469,763 an amine of the group of primary, secondary or tertiary amines, including mono-, di, or higher amines that may be aliphatic, alicyclic or aromatic serves as development accelerator in a developing method wherein an exposed silver halide emulsion layer of a photographic material is first placed in contact with a solution including at least one developing agent and said amine at a pH at which development will not occur substantially and is secondly placed in contact with a solution being sufficiently alkaline, so that after the material has been contacted with said both solutions development occurs. Said development method is applied for rapid processing without the disadvantages of developer oxidation and the production of noxious amine vapours with unpleasant smell.

According to DE-OS No. 3,533,449 aminoalcohols with a pKa value of at least 9 are used in processing solutions for use in the silver complex diffusion transfer process to yield more reproducible image results with time.

It is an object of the present invention to provide an activator development process for use in conjunction with photographic silver chloride emulsion materials to obtain therewith silver images with higher maximum density within shorter processing time.

Other objects and advantages of the present invention will appear from the further description.

In accordance with the present invention a process for developing a photographic material is provided wherein said material contains on a support an image-wise exposed silver halide emulsion layer of which the silver halide is substantially (at least 90 mole %) silver chloride and in which the photographic material before its exposure contains already at least one silver halide developing agent in a hydrophilic colloid binder in waterpermeable relationship with the silver halide, said process containing the step of contacting the exposed photographic material with an aqueous alkaline liquid being initial substantially free from developing agent(s), said contacting being not followed by a silver complex diffusion transfer processing, characterized in that said aqueous alkaline liquid contains a primary and/or secondary amine.

By "initially substantially free" is meant that not more than 0.014 mole of developing agent(s) is present in said alkaline aqueous liquid at the start of the development.

The development proceeds preferably at a pH in the range of 12 to 14. In said pH range developing agents, e.g. hydroquinone, in an amount higher than defined above yield strongly colourized developing baths by oxidation with oxygen of the air.

The contacting of the photographic material with said alkaline solution may proceed by any contacting technique known in the art, e.g. by dipping, meniscus coating or spraying or pod processing. It may proceed manually or automatically in a developing apparatus known to those skilled in the art.

According to a special embodiment the alkalinity of the developer solution is partly obtained by the above defined amines and an alkali-releasing agent consisting of a sodium or potassium salt, e.g. sodium citrate, which reacts with a very slightly water-soluble metal hydroxide, e.g. zink hydroxide, as described in U.S. Pat. No. 3,260,598.

Preferred amines for use according to the present invention are aliphatic primary diamines and primary or secondary alkanol amines containing an alkylene chain of no more than 3 carbon atoms, e.g. $H_2N—CH_2—CH_2—NH_2$ and $H_3C—HN—CH_2—CH_2—OH$.

The amines used according to the present invention are applied in the activator liquid preferably in a concentration in the range of 0.1 g/l to 100 g/l.

Apart from said amines the activator liquid used according to the present invention contains the necessary alkali, e.g. sodium hydroxide, to obtain a pH in the range of 12 to 14 and some amount of anti-oxidizing agent, e.g. a sulphite to protect the amines against aerial oxidation.

The silver chloride contained in the photographic material already incorporating at least one developing agent has preferably a grain size of least at 0.4 μm, since the increase in maximum density is especially pronounced when applying coarser grain size silver chloride emulsions.

The developing agent(s) may be present in the silver halide emulsion layer(s) but are preferably present in a hydrophilic colloid layer in waterpermeable relationship therewith, e.g. in a covering layer serving as anti-stress or protective layer or in an anti-halation layer subjacent to a silver halide emulsion layer of the photographic material.

In a preferred embodiment a mixture of developing agents including a p-dihydroxybenzene and a 3-pyrazolidinone developing agent is used. These developing agents are used preferably in a respective molar ratio of 2/1 to 10/1. The p-dihydroxybenzene is present preferably in an amount of 0.05 to 0.5 g for a coverage of silver halide equivalent with 1 g of silver nitrate.

A preferred para-dihydroxybenzene for use in a photographic material according to the invention is hydroquinone.

3-Pyrazolidinone developing compounds that are useful as auxiliary developing agents in a photographic material developed according to the present invention are within the scope of the following general formula:

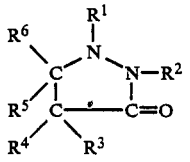

wherein:

$R^1$ represents an aryl group including a substituted aryl group, e.g. phenyl, m-tolyl and p-tolyl, $R^2$ represents hydrogen, a lower ($C_1$–$C_3$) alkyl group e.g. methyl, or an acryl group e.g. acetyl, each of $R^3$, $R^4$, $R^5$ and $R^6$ (which may be the same or different) represents hydrogen, an alkyl group preferably a $C_1$–$C_5$ alkyl group including a substituted alkyl group, or an aryl group including a substituted aryl group.

1-Aryl-3-pyrazolidinone compounds within the scope of the above formula and suitable for use according to the present invention are known e.g. from the GB-P No. 1,093,177 filed Dec. 16, 1964 by Gevaert Photoproducten N.V. Examples are:

1-phenyl-3-pyrazolidinone also known as PHENIDONE (trade name)
1-(m-tolyl)-3-pyrazolidinone
1-phenyl-4-methyl-3-pyrazolidinone
1-phenyl-5-methyl-3-pyrazolidinone
1-phenyl-4,4-dimethyl-3-pyrazolidinone
1,5-diphenyl-3-pyrazolidinone
1-(m-tolyl)-5-phenyl-3-pyrazolidinone
1-(p-tolyl)-5-phenyl-3-pyrazolidinone
and mixtures thereof.

The silver halide emulsion layer(s) of a photographic material developed according to the present invention contain preferably gelatin as hydrophilic binding agent. However, the gelatin may be partly replaced by other natural and/or synthetic hydrophilic colloids, e.g. albumin, casein or zein, polyvinyl alcohol, alginic acids, cellulose derivatives such as carboxymethylcellulose and modified gelatin.

The ratio by weight of hydrophilic colloid binder to silver halide, expressed as an equivalent amount of silver nitrate, in the silver halide emulsion layer(s) of a photographic material developed according to the present invention is preferably in the range of 0.3 to 1.2.

In addition to the binder, silver halide and developing agent(s) the photographic material may contain in the light-sensitive emulsion layer(s) and/or in one or more layers in water-permeable relationship with the silver halide emulsion layer(s) any of the kinds of compounds customarily used in such layers for improving the photographic process, manufacture or keepability (storage). For example such layers may incorporate one or more coating aids, stabilizing agents or antifogging agents as described e.g. in GB-P No. 1,007,020 filed Mar. 6, 1963 by Agfa A.G., plasticizers, spectral sensitizing agents, development-modifying agents e.g. polyoxyalkylene compounds, onium compounds, and sulphur compounds of the class which have sulphur covalently bound derived from an ion such as a mercaptide or xanthate or coordinately bound sulphur from a thioether. Preferably thioethers acting as silver chelating agents with at least two sulphur atoms as donors are used. A survey of thioether compounds suitable for incorporation in silver halide emulsion layers of widely varying silver halide composition has been given in the published European patent application No. 0 026 520.

The support for the light-sensitive silver halide emulsion layer(s) may be any opaque or transparent support customarily employed in the art.

Transparent supports are usually made of organic resins whereas opaque supports are usually made of paper either or not coated with a water-impermeable layer, e.g. of a polyolefine such as polyethylene. Especially for use in graphic art applications the support is coated with an anti-halation layer. In an anti-halation layer a suitable dye or pigment absorbs the light whereto the photographic material is exposed. For example, in panchromatically spectrally sensitized silver halide emulsion materials a removable backing layer containing carbon black is used generally. In blue-sensitive, e.g. sensitive up to 530 nm light, silver halide emulsion materials (that can be treated under yellow lightdarkroom conditions) the anti-halation substance may be a yellow dye or pigment. The anti-halation layer may be combined with a light-reflecting layer to improve the light-sensitivity of the photographic material as described, e.g. in U.S. Pat. No. 4,144,064. A suitable anti-halation layer composition for use in a photographic material developed according to the present invention is described e.g. in U.S. Pat. No. 4,224,402.

In X-ray image recording the exposure may proceed with X-rays directly or X-rays converted into visible light with the the aid of so-called X-ray intensifying screens. The silver chloride for use in X-ray recording materials in conjunction with X-ray intensifying screens emitting visible light e.g. blue and/or green light is spectrally sensitized to blue and/or green light.

In X-ray recording materials normally transparent film supports are used, e.g. made of cellulose acetate, polyvinyl acetal, polystyrene or polyethylene terephthalate provided with a suitable subbing layer(s) known in the art. The X-ray films for use in combination with X-ray intensifying screens are normally double-side coated with a silver halide emulsion layer being sensitive to the fluorescent light emitted by the screen as described e.g. in U.S. Pat. No. 4,130,428.

The present invention is illustrated by the following examples without however restricting it thereto. All parts, percentages and ratios are by weight unless otherwise indicated.

EXAMPLE 1 (comparative example)

A photographic material having on a subbed polyester base a gelatin-silver halide emulsion of which the silver halide consists for 100% of silver chloride having an average grain size of 0.58 μm and a gelatin to silver chloride (expressed in equivalent amount of silver nitrate) ratio of 0.5 and being coated at a coverage corresponding with 4 g of silver nitrate per m2 was provided with a gelatin covering layer (anti-stress layer) containing 20 g of hydroquinone and 5 g of 1-phenyl-3-pyrazolidinone and 40 g of gelatin per 28 m2. The gelatin containing layers were hardened with formaldehyde to improve their mechanical strenght.

The thus obtained photographic material was exposed through a stepwedge and was processed in successive order with an aqueous activation liquid, fixing liquid and rinsing liquid as defined hereinafter. The treatment in each liquid had a duration of 10 seconds at a temperature of 20° C.

| Composition of the activation liquid (per liter). | |
|---|---|
| sodium hydroxide | 30 g |
| sodium sulphite | 50 g |
| potassium bromide | 2 g |
| amine as listed hereinafter in Table 1 | |
| **Composition of the fixing liquid (per liter).** | |
| ammonium thiosulphate | 100 g |
| sodium sulphite | 17 g |
| sodium acetate | 15 g |
| citric acid | 2.5 g |
| acetic acid | 13 ml |

The rinsing liquid was distilled water.

Table 2 contains a survey of the obtained increase of maximum density ($\Delta D_{max}$).

TABLE 1

| Amine No. | Structural formula |
|---|---|
| 1 | $N(C_2H_4OH)_3$ |
| 2 | $C_2H_5)_2—N—C_2H_4OH$ |
| 3 | $N(C_2H_5)_3$ |
| 4 | $CH_3—N(CH_2CH_2OH)_2$ |
| 5 | $CH_3—NH—C_2H_4OH$ |
| 6 | $H_2NCH_2CH_2NH_2$ |
| 7 | $NH_2—CH_2CH_2OH$ |
| 8 | $(CH_3)_2—CH—NH_2$ |
| 9 | 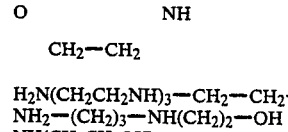 |
| 10 | $H_2N(CH_2CH_2NH)_3—CH_2—CH_2—NH_2$ |
| 11 | $NH_2—(CH_2)_3—NH(CH_2)_2—OH$ |
| 12 | $NH(CH_2CH_2OH)_2$ |

TABLE 2

| Test No. | Amine of Table 2 No. | Amount per liter (g) | $\Delta D_{max}$ (expressed in %) |
|---|---|---|---|
| 1 | — | — | 0 |
| 2 | 1 | 45 | 4 |
| 3 | 2 | 45 | 1 |
| 4 | 3 | 45 | 5 |
| 5 | 4 | 45 | 8 |
| 6 | 5 | 45 | 17 |
| 7 | 6 | 5 | 41 |
| 8 | 7 | 15 | 18 |
| 9 | 8 | 15 | 34 |
| 10 | 9 | 50 | 30 |
| 11 | 10 | 50 | 34 |
| 12 | 11 | 50 | 27 |
| 13 | 12 | 45 | 18 |

From the results obtained can be learned that the addition of tertiary amines in comparison with the blank containing no amine in the activator liquid results in rather poor increase of maximum density, whereas the addition of primary and secondary amines results in a marked improvement.

EXAMPLE 2 (comparative example)

Photographic material 1

The photographic silver chloride emulsion prepared according to Example 1 was double-side coated onto a blue tinted polyester resin support having at both sides a subbing layer for improving the adherence of the coated silver halide emulsion layers. The silver chloride was spectrally sensitized to green light with a green-sensitizing agent as described in Example 1 of U.S. Pat. No. 4,130,428 in an amount of 150 mg to 100 g of silver nitrate used in the preparation of the silver chloride. The silver chloride emulsion was coated at a silver chloride coverage corresponding with 4 g of silver nitrate at each side of the support.

Photographic material 2

Photographic material 2 had the same composition as photographic material 1 with the difference however, that the silver chloride was replaced by silverbromide-iodide (3.95% by weight of silver iodide) grains having an average grain size of 0.55 μm.

Photographic material 3

Photographic material 3 had the same composition as photographic material 1 with the difference however, that onto each silver chloride emulsion layer a covering layer was applied containing 0.75 g of hydroquinone, 0.15 g of 1-phenyl-3-pyrazolidinone and 1.4 g of gelatin per m2 hardened with formaldehyde.

Photographic material 4

Photographic material 4 had the same composition as photographic material 2 with the difference however, that onto each silver bromide-iodide emulsion layer a covering layer was applied containing 0.75 g of hydroquinone, 0.15 g of 1-phenyl-3-pyrazolidinone and 1.4 g of gelatin hardened with formaldehyde.

Exposure

The above defined photographic materials were cut to obtain strips which were exposed under identical conditions to a test object in an X-ray cassette provided with green-light emitting intensifying screens.

Processing I

The strips of photographic materials 1 and 2 were developed for 25 s at 35° C. in a conventional developing bath for processing radiographic materials containing per liter the following ingredients:

| | |
|---|---|
| 1-phenyl-3-pyrazolidinone | 1.5 g |
| hydroquinone | 30 g |
| EDTA tetra-sodium salt | 2 g |
| diethylene glycol | 41 ml |
| 5-nitro-indazole | 250 mg |
| potassium metabisulphite | 54 g |
| glutardialdehyde (25% aqueous solution) | 75 ml |
| potassium carbonate | 32 g |
| potassium hydroxide | 37.7 g |
| acetic acid | 14.7 ml |
| potassium chloride | 0.8 g |
| sodium bromide | 9 g |

(EDTA tetra-sodium salt is the tetra-sodium salt of ethylene diamine tetra-acetic acid being used as calcium complexing agent in tap water)

Processing II

The strips of photographic materials 3 and 4 were developed for 10 s at 20° C. in an aqueous activator liquid containing per liter the following ingredients:

| | |
|---|---|
| sodium hydroxide | 30 g |
| sodium sulphite | 50 g |
| potassium bromide | 2 g |

Processing III

The strips of photographic materials 3 and 4 were developed for 10 s at 20° C. in an activator liquid containing per liter the ingredients of processing II but also 2.5 ml of amine No. 6 of Table 2 and 45 ml of amine No. 5.

The processings I, II and III were followed by a fixing treatment for 10 s at 20° C. in an aqueous fixing liquid containing per liter the following ingredients:

| | |
|---|---|
| ammonium thiosulphate | 100 g |
| sodium sulphite | 17 g |
| sodium acetate | 15 g |
| citric acid | 2.5 g |
| acetic acid | 13 ml |

The fixing of the developed photographic materials was followed by rinsing for 10 s at 20° C. using distilled water.

The obtained sensitometric results, i.e. fog, relative sensitivity (rel. log E) measured at density 1.0 above fog and maximum density ($D_{max}$) are listed in the following Table 3.

TABLE 3

| Photographic material | Processing | Fog | Rel. log E | $D_{max}$ |
|---|---|---|---|---|
| 1 | I | 0.05 | 2.29 | 2.27 |
| 2 | I | 0.08 | 1.95 | 3.57 |
| 3 | II | 0.04 | 2.49 | 2.36 |
| 4 | II | 0.03 | 2.85 | 2.26 |
| 3 | III | 0.09 | 1.84 | 3.74 |
| 4 | III | 0.07 | 2.49 | 2.55 |

A lower rel. log E value means a higher speed; a decrease of 0.3 means a doubling in photographic sensitivity (speed).

From the above results it is clear that the activation processing according to the present invention yields a very substantial increase in speed and maximum density for silver chloride emulsion materials, whereas such is not the case with photographic materials containing mainly silver bromide.

We claim:

1. A process for developing a photographic material containing on a support an image-wise exposed silver halide emulsion layer of which the silver halide is at least 90 mole % silver chloride and in which the photographic material before its exposure contains already at least one silver halide developing agent in a hydrophilic colloid binder in waterpermeable relationship with the silver halide, said process containing the step of contacting the exposed photographic material with an aqueous alkaline liquid being initially substantially free from developing agent(s), said contacting being not followed by a silver complex diffusion transfer processing, characterized in that said aqueous alkaline liquid contains a primary and/or secondary amine.

2. A process according to claim 1, wherein the development proceeds in said aqueous alkaline liquid having a pH in the range of 12 to 14.

3. A process according to claim 1, wherein said amines are aliphatic primary diamines and primary or secondary alkanol amines containing an alkylene chain of no more than 3 carbon atoms.

4. A process according to claim 1, wherein said amines are applied in the activator liquid in a concentration in a range of 0.1 g/l to 100 g/l.

5. A process according to claim 1, wherein apart from said amines the activator liquid contains the necessary alkali to obtain a pH in the range of 12 to 14 and antioxidizing agent to protect the amines against aerial oxidation.

6. A process according to claim 1, wherein the silver chloride has a grain size of least 0.4 μm.

7. A process according to claim 1, wherein the developing agent(s) are present in a hydrophilic colloid layer in waterpermeable relationship with the silver halide emulsion layer.

8. A process according to claim 1, wherein the developing agents are a p-dihydroxybenzene and a 3-pyrazolidinone developing agent.

9. A process according to claim 8, wherein said developing agents are used in a respective molar ratio of 2/1 to 10/1.

10. A process according to claim 8, wherein the p-dihydroxybenzene is hydroquinone.

11. A process according to claim 1, wherein said amines are selected from the group consisting of:
$CH_3—NH—C_2H_4OH$
$H_2NCH_2CH_2NH_2$
$NH_2—CH_2CH_2OH$
$(CH_3)_2—CH—NH_2$
-continued
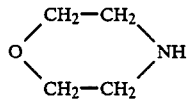
$H_2N(CH_2CH_2NH)_3—CH_2—CH_2—NH_2$
$NH_2—(CH_2)_3—NH(CH_2)_2—OH$, and
$NH(CH_2CH_2OH)_2$.
* * * * *